US006283316B1

(12) United States Patent
Sherman

(10) Patent No.: US 6,283,316 B1
(45) Date of Patent: Sep. 4, 2001

(54) ORIFICE REDUCER FOR MULTI-COMPARTMENT CONTAINER

(76) Inventor: Adam Sherman, 1 Kilmer Rd., Larchmont, NY (US) 10538

( * ) Notice: Subject to any disclaimer, the term of this patent is extended or adjusted under 35 U.S.C. 154(b) by 0 days.

(21) Appl. No.: 09/067,047

(22) Filed: Apr. 27, 1998

(51) Int. Cl.[7] ..... B65D 1/04; B65D 81/32
(52) U.S. Cl. ..... 215/6; 220/526
(58) Field of Search ..... 215/6; 220/526; 222/129

(56) References Cited

U.S. PATENT DOCUMENTS

| | | | | |
|---|---|---|---|---|
| 2,661,871 | * | 12/1953 | Huenergardt | 220/526 X |
| 2,665,816 | * | 1/1954 | Anft | 215/6 X |
| 3,076,573 | * | 2/1963 | Thomas | 215/6 |
| 3,081,926 | * | 3/1963 | Newton | 220/526 X |
| 3,144,152 | * | 8/1964 | Kopp | 215/6 |
| 3,705,661 | * | 12/1972 | Davis | 215/6 |
| 4,277,000 | * | 7/1981 | Jaarsma | 215/6 X |
| 4,856,995 | * | 8/1989 | Wagner | 215/6 X |
| 4,955,503 | * | 9/1990 | Propes | 220/526 |
| 5,143,261 | * | 9/1992 | Drobish | 222/129 |
| 5,289,950 | | 3/1994 | Gentile | 222/142.3 |
| 5,482,170 | | 1/1996 | Semersky et al. | 215/6 |
| 5,573,143 | | 11/1996 | Deardurff et al. | 222/153.14 |
| 5,588,561 | | 12/1996 | Ness | 222/129 |
| 5,758,786 | * | 6/1998 | John | 215/6 |
| 5,765,725 | | 6/1998 | Matt | 222/129 |
| 5,921,440 | * | 7/1999 | Maines | 215/6 X |
| 5,938,053 | * | 8/1999 | Verbovsky et al. | 215/6 |

FOREIGN PATENT DOCUMENTS

| | | |
|---|---|---|
| 42 19 598 A1 | 12/1993 | (DE) . |
| 0 693 437 A1 | 2/1996 | (EP) . |
| 0 730 913 A1 | 11/1996 | (EP) . |

* cited by examiner

*Primary Examiner*—Sue A. Weaver
(74) *Attorney, Agent, or Firm*—Kenyon & Kenyon

(57) ABSTRACT

The present invention is an orifice reducer for a two or more compartment container having a single neck finish. The reducer comprises a plate having two or more apertures, an upper surface, a lower surface, and an outer edge. The two or more apertures are positioned to align with the two or more compartments of the container. The apertures may be of different sizes to allow for the proper dispensing of the different phases of product contained within each compartment of the container.

14 Claims, 3 Drawing Sheets

ORIFICE REDUCER FOR MULTI-COMPARTMENT CONTAINER

FIELD OF THE INVENTION

The present invention relates to orifice reducers. More particularly, the present invention relates to orifice reducers for multi-compartment containers having a single neck finish.

BACKGROUND OF THE INVENTION

The neck of a container typically has an inside diameter, referred to as the "I" dimension, which is fairly large in relation to the overall outer diameter, referred to as the "E" dimension. The purpose of providing such a large opening relative to the entire neck of the container is to facilitate a faster filling operation during production. However, when a viscous product is placed within a container having such a neck finish, the opening provided by that finish is often too large and not suitable for proper dispensing of the product. Therefore, a smaller diameter opening is required. With the methods utilized for molding of containers, namely extrusion blow molding, and injection blow molding, it would be extremely difficult to mold a container neck finish with a smaller opening without substantially increasing the thickness of the wall of the neck, and therefore increasing the amount of material required to produce each container.

To keep the amount of material needed at a minimum, orifice reducers have been developed. These reducers are placed on the sealing surface of the neck finish of a container and serve to provide a narrower orifice through which the product in the container can be dispensed. These reducers are typically a disk which attaches to the neck finish of the container. The disk is provided with an orifice smaller than that of the neck finish.

Certain products are composed of multiple phases which need to be kept separate until ready for use. In order to keep the phases separate, this type of formula has been packaged in multiple containers where each container is attached to the other to form a single unit. The problem with the use of this style package is that each container has its own neck finish, and thus its own closure. In order for the consumer to access the product, the consumer must remove each closure, pour out the product, and then replace the closure in order to avoid spillage.

Developments have been made in which a multiple chamber container has been molded wherein the container has a single neck finish and dividing walls extend throughout the container and the neck finish to keep the chambers separate. These containers have been found useful for keeping the phases of a multi-phase formula separate while providing a single neck finish. When these containers are molded, however, they still need to have a sufficient area through which each phase of the product can be filled into its respective container chamber. Thus, the opening within the neck needs to be fairly wide for each chamber.

The present invention provides for an orifice reducer for use with multiple chambered containers having a single neck finish. The orifice reducer is simple to manufacture, and is effective in allowing for the proper dispensing of a product having more than one phase, wherein each phase is contained within a different chamber of a container.

SUMMARY OF THE INVENTION

The present invention is an orifice reducer for a two or more compartment container having a single neck finish.

The reducer comprises a plate having two or more apertures, an upper surface, a lower surface, and an outer edge. The two or more apertures are positioned to align with the two or more compartments of the container. The apertures may be of different sizes to allow for the proper dispensing of the different phases of product contained within each compartment of the container.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Traditional multi-chambered containers comprised two separate containers attached together, each with their own neck finish, orifice reducer, and closure. When these containers were attached together, the respective neck finishes of each had to be a sufficient distance apart so that a closure could be easily applied and removed from each. With this style multichambered container, mixing of the separate portions of the product together is difficult because of the significant required distance between the neck finishes and typically, the consumer has to perform an additional step so that the product can be effectively mixed together. The use of the present orifice reducer with a multi-compartment container having a single neck finish allows for the controlled dispensing of separate portions of a single product through a common passageway, i.e., the single neck finish of the container. This controlled dispensing at one location places the separate portions of the product in such proximity that mixing of the portions together does not require any additional steps on the part of the consumer.

Figure 1:
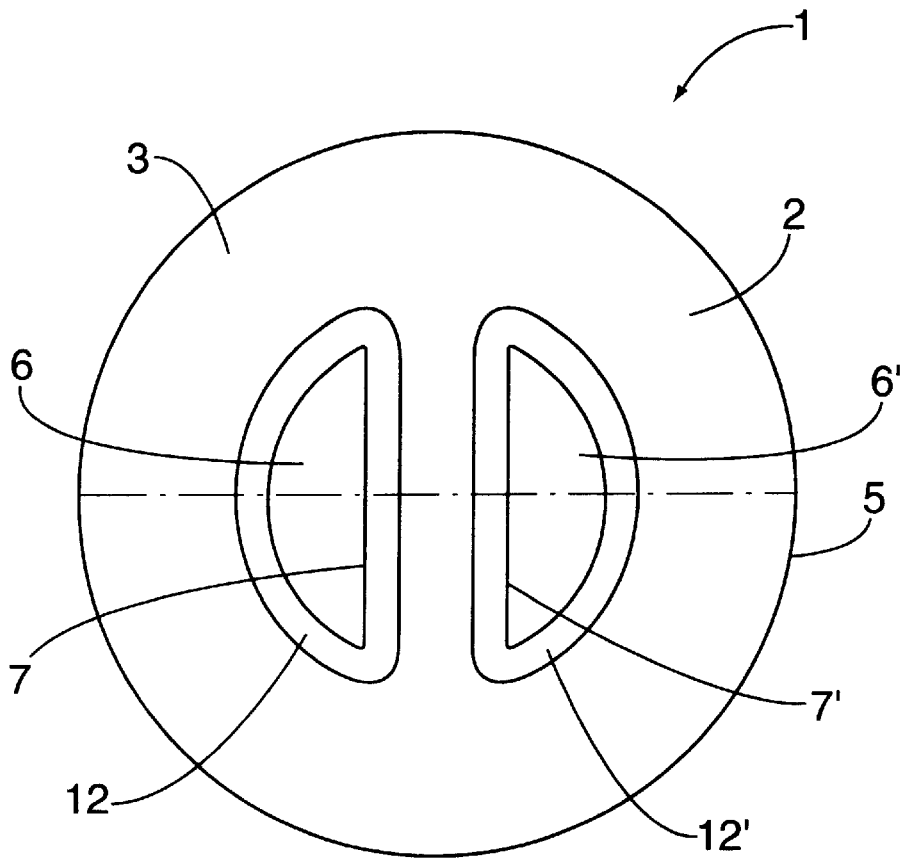
FIG. 1 is a top plan view of the orifice reducer of the present invention having two apertures.
Figure 2:
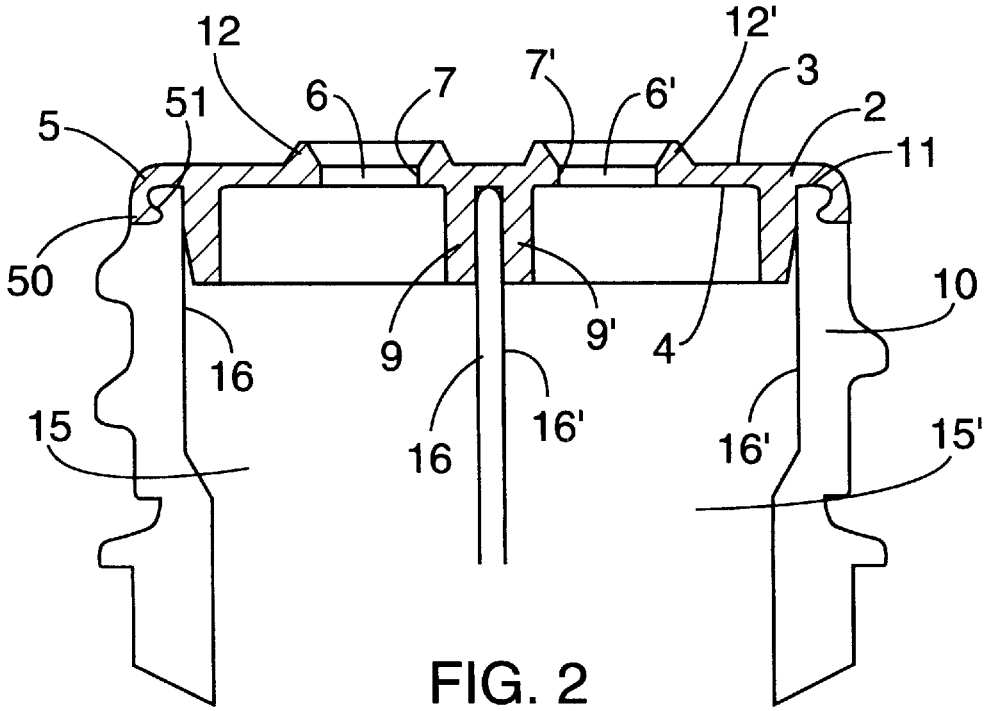
FIG. 2 is a side cross-sectional view of the orifice reducer of FIG. 1.

Referring now to the drawings, the orifice reducer 1 of the present invention, as seen in FIGS. 1 and 2, comprises a plate 2 having an upper surface 3, a lower surface 4, and an outer edge 5. The orifice reducer 1 of the present invention is placed on a container neck finish 10 in the same manner as that of a traditional orifice reducer, i.e., it is simply positioned on the sealing surface 11 of the neck 10, as seen in FIG. 2.

Figure 3:
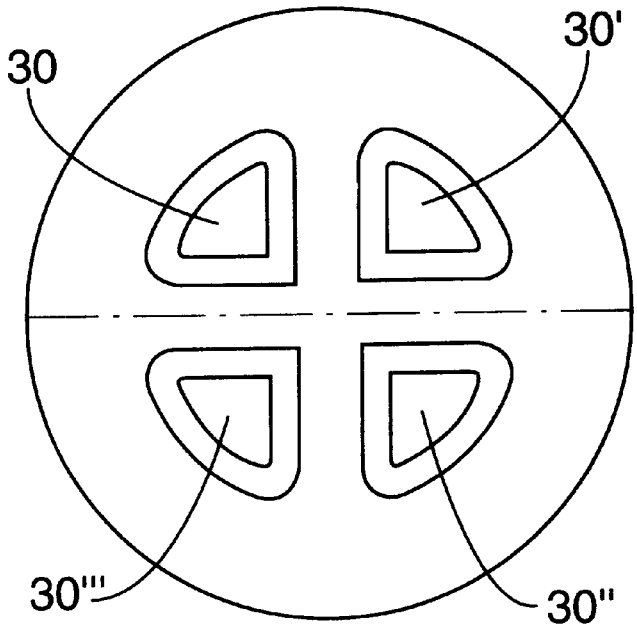
FIG. 3 is a top plan view of the orifice reducer of the present invention having four apertures.
Figure 4:
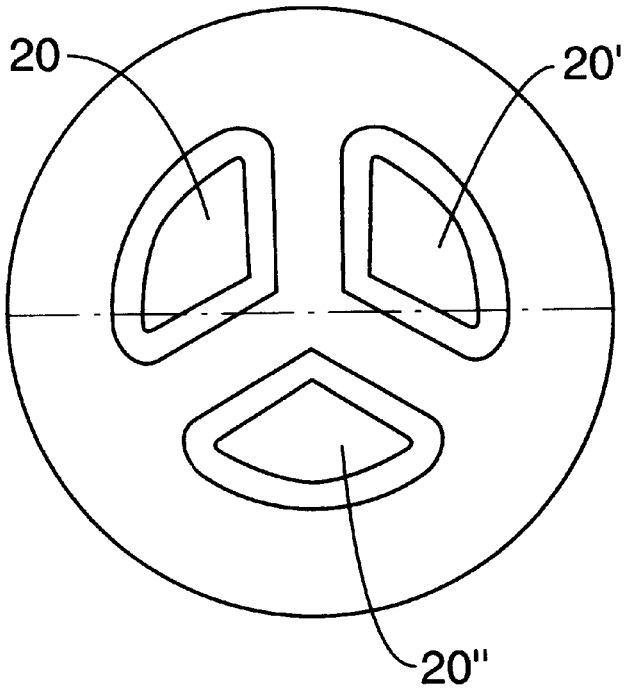
FIG. 4 is a top plan view of the orifice reducer of the present invention having three apertures.

The plate 2 is provided with two or more apertures 6 and 6'. Each aperture 6 and 6' is positioned on the plate 2 such that each aligns with a separate compartment 15 and 15' of the container. For example, as seen with the orifice reducer of FIG. 2, which is one designed to be used with a container having a first compartment 15 and a second compartment 15', the first aperture 6 is positioned to align with the first compartment 15 of the container, and the second aperture 6' is positioned to align with the second compartment 15'. In a preferred embodiment, the apertures are arranged as close as possible to the center of the plate, with their outer perimeters together defining a circular shape. For example, when the container has two separate compartments, the preferred shape of the apertures will be "D" shaped, as shown in FIG. 1. This shape will allow the apertures 6 and 6' to be positioned close together along the straight edges 7 and 7' of aperture 6 and 6', which in turn, allows the product within each compartment 15 and 15' to be dispensed closer together. The number of apertures provided on the plate 2 will vary depending on the number of compartments in the container. For example, if the container has three compartments the reducer will have three apertures 20, 20', 20" (as in FIG. 4); if the container has four compartments, the reducer will have four apertures 30, 30', 30", and 30'" (as in FIG. 3); and so on. As with the two apertures, although necessarily somewhat differently shaped, the multiple apertures on these reducers can have the same circular arrangement, with their straight edges positioned as close as possible to each other around the center.

Depending on the viscosity of the product within each compartment of the container, the size and shape of the apertures may vary accordingly. For example, if the phase in one of the compartments has a high viscosity, then the corresponding aperture will be larger than that of the phase with a lower viscosity. When each phase has a different viscosity, a different aperture size may be desirable for the most efficient and equal simultaneous dispensing of the product.

As seen in FIG. 2, a separate continuous wall 9 and 9' for each container compartment depends from the lower surface 4 of the plate 2. Each wall 9 and 9' is positioned so that a passageway is defined between the container compartments 15 and 15' and their respective apertures 6 and 6'. Each wall 9 and 9' is dimensioned to separate each compartment by sealing against the inner surface 16 and 16' of each compartment, as seen in FIG. 2. In other words, the walls 9 and 9' are dimensioned to define the apertures 6 and 6' and provide a seal around each compartment 15 and 15' of the container through which the product cannot pass, thereby preventing leakage.

Preferably, the outer edge 5 of the plate 2 is provided with a retaining flange 50. The flange 50 cooperates with an undercut 51 provided on the sealing surface 11 of the neck finish 10 to hold the reducer in place on the neck 10. There are, however, other means by which the reducer can be held in place on the neck finish. These means include such things as, for example, a friction fit between the reducer and the inside diameter on the neck finish, an adhesive applied between the reducer and the neck finish, or an actual welding of the reducer to the neck finish.

Figure 5:
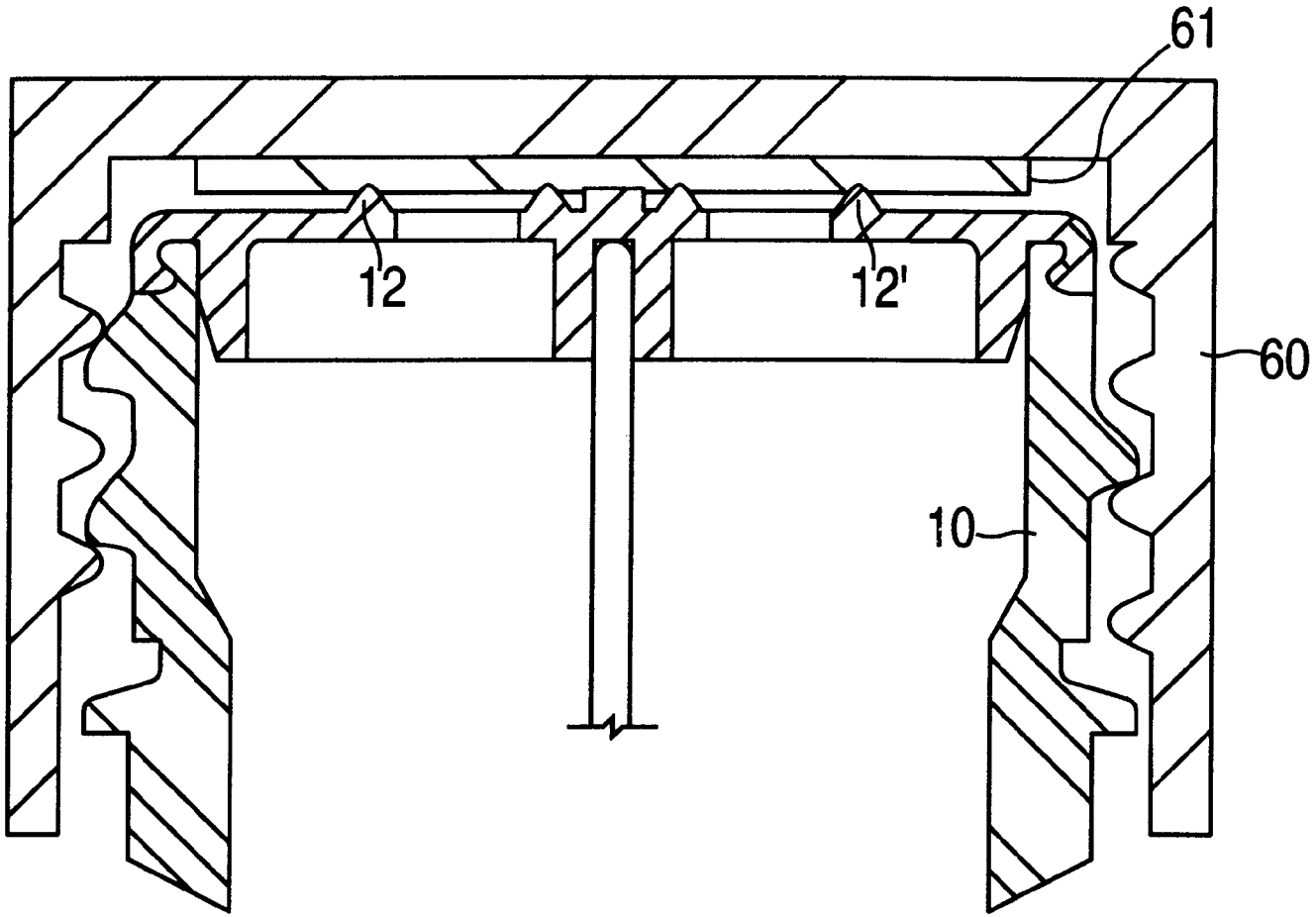
FIG. 5 is the same as FIG. 2 with the addition of a closure with a liner.

To assist with the sealing of the orifice reducer against the closure 60 to prevent leakage of the product from around said closure, each aperture 6 and 6' is preferably provided with a sealing rim 12 and 12' on the upper surface 3 of the plate 2. The sealing rims 12 and 12' are raised projections which define their respective apertures 6 and 6', as seen in FIG. 2. When a closure containing a compressible liner (61) is placed on the neck finish 10 and tightened, the liner of the closure first contacts the sealing rims 12 and 12' (see FIG. 5) and, as the closure is tightened further, the sealing rims 12 and 12' cause the liner to compress in the area of contact between the sealing rims and the liner, thus conforming to their shape and making a tight seal through which the product cannot escape. The use and function of a closure with a compressible liner is well known as being an effective means for sealing the opening of a container. The compressible liner used with the closure can be a stationary liner which does not rotate with respect to the closure, or a rotating liner which does rotate with respect to the closure.

The above-described orifice reducer will preferably be injection molded. The preferred materials will be plastics which are flexible in nature, such as polyethylene, polypropylene, or vinyl. Different materials will require variations in the molding parameters, these variations being well known to one of skill in the art of injection molding.

The invention, and its broader aspects, is not limited to the specific details shown and described; rather, various modifications will be suggested to one skilled in the art, all of which are within the scope of this invention.

What is claimed is:

1. An orifice reducer for a two or more compartment container having a single threaded neck finish, which comprises:

a plate with two or more apertures, said plate having an upper surface, a lower surface, an outer edge, and the two or more apertures aligning with the two or more compartments of the container;

a continuous wall depending from the lower surface into each compartment of the container, each wall sealing its respective compartment from the other compartments by providing a seal around the inner surface of the compartment, and each wall defining a passageway from its respective compartment to its respective aperture; and a threaded closure for sealing the threaded neck finish.

2. The orifice reducer of claim 1 herein the outer edge of the plate is provided with a retaining flange that cooperates with the neck finish to hold the reducer in place.

3. The orifice reducer of claim 1 wherein the reducer is friction fit within the neck finish of the container.

4. The orifice reducer of claim 1 wherein a sealing rim on the upper surface of the plate defines the apertures.

5. The orifice reducer of claim 1 wherein the apertures are "D" shaped.

6. The orifice reducer of claim 1 wherein the closure has a compressible liner.

7. The orifice reducer of claim 6 wherein the liner is rotatable or stationary with respect to the closure.

8. A two or more compartment container having a single threaded neck finish with an orifice reducer, said orifice reducer comprising:

a plate with two or more apertures, said plate having an upper surface, a lower surface, an outer edge, and the two or more apertures aligning with the two or more compartments of the container;

a continuous wall depending from the lower surface into each compartment of the container, each wall sealing its respective compartment from the other compartments by providing a seal around the inner surface of the compartment, and each wall defining a passageway from its respective compartment to its respective aperture; and a threaded closure for sealing the threaded neck finish.

9. The orifice reducer of claim 8 wherein the outer edge of the plate is provided with a retaining flange that cooperates with the neck finish to hold the reducer in place.

10. The container of claim 8 wherein the reducer is friction fit within the neck finish of the container.

11. The container of claim 8 wherein a sealing rim on the upper surface of the plate defines the apertures.

12. The container of claim 8 wherein the apertures are "D" shaped.

13. The container of claim 8 wherein the closure has a compressible liner.

14. The container of claim 13 wherein the liner is rotatable or stationary with respect to the closure.

* * * * *